US008057562B2

(12) United States Patent
Middlemiss

(10) Patent No.: US 8,057,562 B2
(45) Date of Patent: Nov. 15, 2011

(54) THERMALLY STABLE ULTRA-HARD POLYCRYSTALLINE MATERIALS AND COMPACTS

(75) Inventor: Stewart N. Middlemiss, Salt Lake City, UT (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 12/633,641

(22) Filed: Dec. 8, 2009

(65) Prior Publication Data

US 2010/0084194 A1 Apr. 8, 2010

Related U.S. Application Data

(62) Division of application No. 11/672,349, filed on Feb. 7, 2007, now Pat. No. 7,628,234.

(60) Provisional application No. 60/771,722, filed on Feb. 9, 2006.

(51) Int. Cl.

| | |
|---|---|
| ***B24D 3/00*** | (2006.01) |
| ***B24D 18/00*** | (2006.01) |
| ***C22C 29/16*** | (2006.01) |

(52) U.S. Cl. ..... 51/307; 51/293

(58) Field of Classification Search ..... 175/327–435; 51/293, 307, 309

See application file for complete search history.

(56) References Cited

U.S. PATENT DOCUMENTS

| | | | |
|---|---|---|---|
| 3,136,615 | A | 6/1964 | Bovenkerk et al. |
| 3,141,746 | A | 7/1964 | Lai |
| 3,233,988 | A | 2/1966 | Wentorf, Jr. et al. |
| 3,745,623 | A | 7/1973 | Wentorf, Jr. et al. |
| 4,108,614 | A | 8/1978 | Mitchell |
| 4,151,686 | A | 5/1979 | Lee et al. |
| 4,224,380 | A | 9/1980 | Bovenkerk et al. |
| 4,255,165 | A | 3/1981 | Dennis et al. |
| 4,268,276 | A | 5/1981 | Bovenkerk |
| 4,288,248 | A | 9/1981 | Bovenkerk et al. |
| 4,303,442 | A | 12/1981 | Hara et al. |

(Continued)

FOREIGN PATENT DOCUMENTS

| | | |
|---|---|---|
| EP | 0 196 777 | 10/1986 |

(Continued)

OTHER PUBLICATIONS

UK Intellectual Property Office, Search Report under Patents Act 1977, Section 17 re UK Application No. GB 0702488.8, Claims 1-37 Searched on Jun. 1, 2007.

(Continued)

*Primary Examiner* — Jerry A Lorengo
*Assistant Examiner* — Jared Wood
(74) *Attorney, Agent, or Firm* — Connolly Bove Lodge & Hutz LLP

(57) ABSTRACT

Thermally stable ultra-hard polycrystalline materials and compacts comprise an ultra-hard polycrystalline body that wholly or partially comprises one or more thermally stable ultra-hard polycrystalline region. A substrate can be attached to the body. The thermally stable ultra-hard polycrystalline region can be positioned along all or a portion of an outside surface of the body, or can be positioned beneath a body surface. The thermally stable ultra-hard polycrystalline region can be provided in the form of a single element or in the form of a number of elements. The thermally stable ultra-hard polycrystalline region can be formed from precursor material, such as diamond and/or cubic boron nitride, with an alkali metal catalyst material. The mixture can be sintered by high pressure/high temperature process.

23 Claims, 5 Drawing Sheets

U.S. PATENT DOCUMENTS 4,311,490 A 1/1982 Bovenkerk et al.
4,373,593 A 2/1983 Phaal et al.
4,387,287 A 6/1983 Marazzi
4,412,980 A 11/1983 Tsuji et al.
4,481,016 A 11/1984 Campbell et al.
4,486,286 A 12/1984 Lewin et al.
4,504,519 A 3/1985 Zelez
4,522,633 A 6/1985 Dyer
4,525,179 A 6/1985 Gigl
4,534,773 A 8/1985 Phaal et al.
4,556,403 A 12/1985 Almond et al.
4,560,014 A 12/1985 Geczy
4,570,726 A 2/1986 Hall
4,572,722 A 2/1986 Dyer
4,604,106 A 8/1986 Hall
4,605,343 A 8/1986 Hibbs, Jr. et al.
4,606,738 A 8/1986 Hayden
4,621,031 A 11/1986 Scruggs
4,629,373 A 12/1986 Hall
4,636,253 A 1/1987 Nakai et al.
4,645,977 A 2/1987 Kurokawa et al.
4,662,348 A 5/1987 Hall et al.
4,664,705 A 5/1987 Horton et al.
4,670,025 A 6/1987 Pipkin
4,694,918 A 9/1987 Hall
4,707,384 A 11/1987 Schachner et al.
4,729,440 A 3/1988 Hall
4,766,040 A 8/1988 Hillert et al.
4,776,861 A 10/1988 Frushour
4,784,023 A 11/1988 Dennis
4,792,001 A 12/1988 Zijsling
4,793,828 A 12/1988 Burnand
4,797,241 A 1/1989 Peterson et al.
4,802,539 A 2/1989 Hall et al.
4,807,402 A 2/1989 Rai
4,828,582 A 5/1989 Frushour
4,844,185 A 7/1989 Newton, Jr. et al.
4,861,350 A 8/1989 Phaal et al.
4,871,377 A 10/1989 Frushour
4,899,922 A 2/1990 Slutz et al.
4,919,220 A 4/1990 Fuller et al.
4,940,180 A 7/1990 Martell
4,943,488 A 7/1990 Sung et al.
4,944,772 A 7/1990 Cho
4,976,324 A 12/1990 Tibbitts
5,011,514 A 4/1991 Cho et al.
5,027,912 A 7/1991 Juergens
5,030,276 A 7/1991 Sung et al.
5,092,687 A 3/1992 Hall
5,116,568 A 5/1992 Sung et al.
5,120,327 A 6/1992 Dennis
5,127,923 A 7/1992 Bunting et al.
5,135,061 A 8/1992 Newton, Jr.
5,176,720 A 1/1993 Martell et al.
5,186,725 A 2/1993 Martell et al.
5,199,832 A 4/1993 Meskin et al.
5,205,684 A 4/1993 Meskin et al.
5,213,248 A 5/1993 Horton et al.
5,238,074 A 8/1993 Tibbitts et al.
5,264,283 A 11/1993 Waldenstrom et al.
5,337,844 A 8/1994 Tibbitts
5,370,195 A 12/1994 Keshavan et al.
5,379,853 A 1/1995 Lockwood et al.
5,439,492 A 8/1995 Anthony et al.
5,464,068 A 11/1995 Najafi-Sani
5,468,268 A 11/1995 Tank et al.
5,469,927 A 11/1995 Griffin
5,496,638 A 3/1996 Waldenstrom et al.
5,505,748 A 4/1996 Tank et al.
5,510,193 A 4/1996 Cerutti et al.
5,523,121 A 6/1996 Anthony et al.
5,524,719 A 6/1996 Dennis
5,560,716 A 10/1996 Tank et al.
5,601,477 A 2/1997 Bunting et al.
5,607,024 A 3/1997 Keith et al.
5,620,382 A 4/1997 Cho et al.
5,624,068 A 4/1997 Waldenstrom et al.
5,645,617 A 7/1997 Frushour
5,667,028 A 9/1997 Truax et al.
5,706,906 A 1/1998 Jurewicz et al.
5,718,948 A 2/1998 Ederyd et al.
5,722,499 A 3/1998 Nguyen et al.
5,769,176 A 6/1998 Sumiya et al.
5,776,615 A 7/1998 Wong et al.
5,803,196 A 9/1998 Fielder
5,833,021 A 11/1998 Mensa-Wilmot et al.
5,890,552 A 4/1999 Scott et al.
5,897,942 A 4/1999 Karner et al.
5,954,147 A 9/1999 Overstreet et al.
5,979,578 A 11/1999 Packer
6,006,846 A 12/1999 Tibbitts et al.
6,009,963 A 1/2000 Chaves et al.
6,050,354 A 4/2000 Pessier et al.
6,063,333 A 5/2000 Dennis
6,123,612 A 9/2000 Goers
6,126,741 A 10/2000 Jones et al.
6,149,695 A 11/2000 Adia et al.
6,234,261 B1 5/2001 Evans et al.
6,248,447 B1 6/2001 Griffin et al.
6,269,894 B1 8/2001 Griffin
6,332,503 B1 12/2001 Pessier et al.
6,344,149 B1 2/2002 Oles
6,361,873 B1 3/2002 Yong et al.
6,410,085 B1 6/2002 Griffin et al.
6,435,058 B1 8/2002 Matthias et al.
6,443,248 B2 9/2002 Yong et al.
6,544,308 B2 4/2003 Griffin et al.
6,585,064 B2 7/2003 Griffin et al.
6,592,985 B2 7/2003 Griffin et al.
6,601,662 B2 8/2003 Matthias et al.
6,749,033 B2 6/2004 Griffin et al.
7,350,601 B2 4/2008 Belnap et al.
7,635,035 B1 * 12/2009 Bertagnolli et al. ..... 175/434
2003/0021995 A1 1/2003 Griffin et al.
2003/0196385 A1 10/2003 Middlemiss
2003/0235691 A1 12/2003 Griffin et al.
2005/0136667 A1 6/2005 Sung
2005/0139397 A1 6/2005 Achilles et al.
2005/0230156 A1 10/2005 Belnap et al.
2007/0181348 A1 8/2007 Lancaster et al.

FOREIGN PATENT DOCUMENTS

EP 0300699 1/1989
EP 0329954 8/1989
EP 0500253 8/1992
EP 0595630 5/1994
EP 0612868 8/1994
EP 0617207 9/1994
EP 0787820 8/1997
EP 0860515 8/1998
EP 1712649 10/2006
GB 1349385 4/1974
GB 2048927 12/1980
GB 2268768 1/1994
GB 2323398 9/1998
JP 59219500 12/1984
RU 2034937 5/1995
WO 9323204 11/1993
WO 9634131 10/1996
WO 0028106 5/2000
WO 2004040095 5/2004
WO 2004098875 11/2004
WO 2004106003 12/2004
WO 2004106004 12/2004

OTHER PUBLICATIONS

Restriction Requirement for parent U.S. Appl. No. 11/672,349, now Pat 7,628,234; dated Jan. 2, 2009; 8 pages.

Nonfinal Office Action for parent U.S. Appl. No. 11/672,349, now Pat 7,628,234; dated Mar. 12, 2009; 8 pages.

* cited by examiner

THERMALLY STABLE ULTRA-HARD POLYCRYSTALLINE MATERIALS AND COMPACTS

CROSS-REFERENCE TO RELATED APPLICATIONS

This application is a divisional of U.S. patent application Ser. No. 11/672,349 filed Feb. 7, 2007, which claims the benefit from U.S. Provisional Patent Application No. 60/771,722 filed on Feb. 9, 2006, which are herein incorporated by reference in their entirety.

FIELD OF THE INVENTION

This invention generally relates to ultra-hard materials and, more specifically, to ultra-hard polycrystalline materials and compacts formed therefrom that are specially engineered having improved properties of thermal stability, wear resistance and hardness when compared to conventional ultra-hard polycrystalline materials such as conventional polycrystalline diamond.

BACKGROUND OF THE INVENTION

Polycrystalline diamond (PCD) materials and PCD elements formed therefrom are well known in the art. Conventional PCD is formed by combining diamond grains with a suitable solvent catalyst material to form a mixture. The mixture is subjected to processing conditions of extremely high pressure/high temperature (HP/HT), where the solvent catalyst material promotes desired intercrystalline diamond-to-diamond bonding between the grains, thereby forming a PCD structure. The resulting PCD structure produces enhanced properties of wear resistance and hardness, making PCD materials extremely useful in aggressive tooling, wear, and cutting applications where high levels of wear resistance and hardness are desired.

Solvent catalyst materials typically used for forming conventional PCD include metals from Group VIII of the Periodic table, with cobalt (Co) being the most common. Conventional PCD can comprise from 85 to 95% by volume diamond and a remaining amount of the solvent catalyst material. The solvent catalyst material is present in the microstructure of the PCD material within interstices that exist between the bonded together diamond grains.

A problem known to exist with such conventional PCD materials is thermal degradation due to differential thermal expansion characteristics between the interstitial solvent catalyst material and the intercrystalline bonded diamond. Such differential thermal expansion is known to occur at temperatures of about 400° C., causing ruptures to occur in the diamond-to-diamond bonding, and resulting in the formation of cracks and chips in the PCD structure.

Another problem known to exist with conventional PCD materials is also related to the presence of the solvent catalyst material in the interstitial regions and the adherence of the solvent catalyst to the diamond crystals to cause another form of thermal degradation. Specifically, the solvent catalyst material is known to cause an undesired catalyzed phase transformation in diamond (converting it to carbon monoxide, carbon dioxide, or graphite) with increasing temperature, thereby limiting practical use of the PCD material to about 750° C.

Attempts at addressing such unwanted forms of thermal degradation in PCD are known in the art. Generally, these attempts have involved the formation of a PCD body having an improved degree of thermal stability when compared to the conventional PCD material discussed above. One known technique of producing a thermally stable PCD body involves at least a two-stage process of first forming a conventional sintered PCD body, by combining diamond grains and a cobalt solvent catalyst material and subjecting the same to high pressure/high temperature process, and then removing the solvent catalyst material therefrom.

This method, which is fairly time consuming, produces a resulting PCD body that is substantially free of the solvent catalyst material, and is therefore promoted as providing a PCD body having improved thermal stability. However, the resulting thermally stable PCD body typically does not include a metallic substrate attached thereto by solvent catalyst infiltration from such substrate due to the solvent catalyst removal process.

The thermally stable PCD body also has a coefficient of thermal expansion that is sufficiently different from that of conventional substrate materials (such as WC-Co and the like) that are typically infiltrated or otherwise attached to the PCD body to provide a PCD compact that adapts the PCD body for use in many desirable applications. This difference in thermal expansion between the thermally stable PCD body and the substrate, and the poor wetability of the thermally stable PCD body diamond surface makes it very difficult to bond the thermally stable PCD body to conventionally used substrates, thereby requiring that the PCD body itself be attached or mounted directly to a device for use.

However, since such conventional thermally stable PCD body is devoid of a metallic substrate, it cannot (e.g., when configured for use as a drill bit cutter) be attached to a drill bit by conventional brazing process. The use of such thermally stable PCD body in this particular application necessitates that the PCD body itself be mounted to the drill bit by mechanical or interference fit during manufacturing of the drill bit, which is labor intensive, time consuming, and which does not provide a most secure method of attachment.

Additionally, because such conventional thermally stable PCD body no longer includes the solvent catalyst material, it is known to be relatively brittle and have poor impact strength, thereby limiting its use to less extreme or severe applications and making such thermally stable PCD bodies generally unsuited for use in aggressive applications such as subterranean drilling and the like.

It is, therefore, desired that a diamond material be developed that has improved thermal stability when compared to conventional PCD materials. It is also desired that a diamond compact be developed that includes a thermally stable diamond material bonded to a suitable substrate to facilitate attachment of the compact to an application device by conventional method such as welding or brazing and the like. It is further desired that such thermally stable diamond material and compact formed therefrom have properties of hardness/toughness and impact strength that are the same or better than that of conventional thermally stable PCD material described above, and PCD compacts formed therefrom. It is further desired that such a product can be manufactured at reasonable cost.

SUMMARY OF THE INVENTION

Thermally stable ultra-hard polycrystalline materials and compacts of this invention generally comprise an ultra-hard polycrystalline body including one or more thermally stable ultra-hard polycrystalline regions disposed therein. The ultra-hard polycrystalline body may additionally comprise a substrate attached or integrally joined to the body, thereby providing a thermally stable diamond bonded compact.

The thermally stable ultra-hard polycrystalline region can be positioned along all or a portion of a working surface of the body, that may exist along a top surface of the body and/or a sidewall surface of the body. Alternatively, the thermally stable ultra-hard polycrystalline region can be positioned beneath a working surface of the body. As noted above, the thermally stable ultra-hard polycrystalline region can be provided in the form of a single element or in the form of a number of elements that are disposed within or connected with the body. The placement position and number of thermally stable ultra-hard polycrystalline regions in the body can and will vary depending on the particular end use application.

In an example embodiment, the thermally stable ultra-hard polycrystalline region is formed by combining an ultra-hard polycrystalline material precursor material, such as diamond grains and/or cubic boron nitride grains, with a catalyst material selected from the group consisting of alkali metal catalysts. The mixture is sintered by HPHT process. In an example embodiment, the thermally stable ultra-hard polycrystalline material is formed in a separate HPHT process than that used to form a remaining portion of the ultra-hard polycrystalline body, e.g., when the remaining portion of the body is formed from conventional PCD. The resulting thermally stable ultra-hard polycrystalline material has a material microstructure comprising intercrystalline bonded together ultra-hard material grains and the alkali metal carbonate catalyst disposed within interstitial regions between the bonded together diamond grains Thermally stable ultra-hard polycrystalline materials and compacts formed therefrom according to principles of this invention have improved properties of thermal stability, wear resistance and hardness when compared to conventional ultra-hard materials, such as conventional PCD materials, and include a substrate to facilitate attachment of the compact to an application device by conventional method such as welding or brazing and the like.

BRIEF DESCRIPTION OF THE DRAWING

These and other features and advantages of the present invention will be appreciated as the same becomes better understood by reference to the following detailed description when considered in connection with the accompanying drawings wherein.

DETAILED DESCRIPTION

Figure 1:
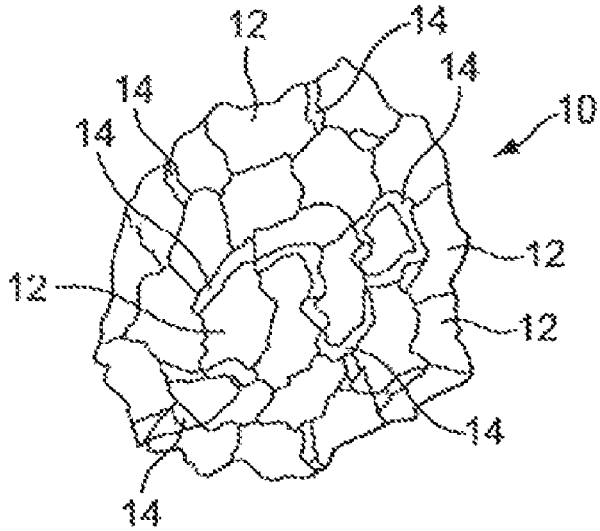
FIG. 1 is schematic view taken from a thermally stable region of an ultra-hard polycrystalline material of this invention.

Thermally stable ultra-hard polycrystalline materials and compacts of this invention are specifically engineered having an ultra-hard polycrystalline body that is either entirely or partially formed from a thermally stable material, thereby providing improved properties of thermal stability, wear resistance and hardness when compared to conventional ultra-hard polycrystalline materials such as conventional PCD. As used herein, the term PCD is used to refer to polycrystalline diamond that has been formed, at high pressure/high temperature (HPHT) conditions, through the use of a metal solvent catalyst, such as those metals included in Group VIII of the Periodic table.

The thermally stable region in ultra-hard polycrystalline materials and compacts of this invention, while comprising a polycrystalline construction of bonded together diamond crystals is not referred to herein as being PCD because, unlike conventional PCD and thermally stable PCD, it is not formed by using a metal solvent catalyst or by removing a metal solvent catalyst. Rather, as discussed in greater detail below, thermally stable ultra-hard materials of this invention are formed by combining a precursor ultra-hard polycrystalline material with an alkali metal carbonate catalyst material.

In one embodiment of this invention, the thermally stable ultra-hard polycrystalline materials may form the entire polycrystalline body that is attached to a substrate and that forms a compact. Alternatively, in other invention embodiments, the thermally stable ultra-hard polycrystalline material may form one or more regions of an ultra-hard polycrystalline body comprising another ultra-hard polycrystalline material, e.g., PCD, and the ultra-hard polycrystalline body is attached to a substrate to form a desired compact. A feature of such thermally stable ultra-hard polycrystalline compacts of this invention is the presence of a substrate that enables the compacts to be attached to tooling, cutting or wear devices, e.g., drill bits when the diamond compact is configured as a cutter, by conventional means such as by brazing and the like.

Thermally stable ultra-hard polycrystalline materials and compacts of this invention are formed during one or more HPHT processes depending on the particular compact embodiment. In an example embodiment, where the thermally stable ultra-hard polycrystalline material forms the entire polycrystalline body, the polycrystalline body can be formed during one HPHT process. The so-formed polycrystalline body can then be attached to a substrate by either vacuum brazing method or the like, or by a subsequent HPHT process. Alternatively, the polycrystalline body can be formed and attached to a designated substrate during the same HPHT process.

In an example embodiment where the thermally stable ultra-hard polycrystalline material occupies one or more region in an ultra-hard polycrystalline body that comprises a remaining region formed from another ultra-hard polycrystalline material, the thermally stable ultra-hard polycrystalline material is formed separately during a HPHT process. The so formed thermally stable ultra-hard polycrystalline material can either be incorporated into the remaining ultra-hard polycrystalline body by either inserting it into the HPHT process used to form the other ultra-hard polycrystalline material, or by separately forming the other ultra-hard polycrystalline material and then attaching the thermally stable ultra-hard polycrystalline material thereto by another HPHT process, or attaching it with a process such as brazing. The compact substrate of such embodiment can be joined to the ultra-hard polycrystalline body during either the HPHT process used to form the remaining ultra-hard polycrystalline material or during a third HPHT process used to join the two ultra-hard polycrystalline materials together. The methods used to form thermally stable ultra-hard polycrystalline materials and compacts of this invention are described in better detail below.

FIG. 1 illustrates a region of a thermally stable ultra-hard polycrystalline material 10 of this invention having a material microstructure comprising the following material phases. A first material phase 12 comprises a polycrystalline phase of intercrystalline bonded ultra-hard crystals formed by the bonding together of adjacent ultra-hard grains at HPHT sintering conditions. Example ultra-hard materials useful for forming this phase include diamond, cubic boron nitride, and mixtures thereof. In an example embodiment, diamond is a preferred ultra-hard material for forming a first phase comprising polycrystalline diamond. A second material phase 14 is disposed interstitially between the bonded together ultra-hard grains and comprises a catalyst material for facilitating the bonding together of the ultra-hard grains during the HPHT process.

Diamond grains useful for forming thermally stable ultra-hard polycrystalline materials of this invention include synthetic diamond powders having an average diameter grain size in the range of from submicrometer in size to 100 micrometers, and more preferably in the range of from about 5 to 80 micrometers. The diamond powder can contain grains having a mono or multi-modal size distribution. In an example embodiment, the diamond powder has an average grain size of approximately 20 micrometers. In the event that diamond powders are used having differently sized grains, the diamond grains are mixed together by conventional process, such as by ball or attrittor milling for as much time as necessary to ensure good uniform distribution.

The diamond grain powder is preferably cleaned, to enhance the sinterability of the powder by treatment at high temperature, in a vacuum or reducing atmosphere. In one example embodiment, the diamond powder is combined with a volume of a desired catalyst material to form a mixture, and the mixture is loaded into a desired container for placement within a suitable HPHT consolidation and sintering device. In another embodiment, the catalyst material can be provided in the form of an object positioned adjacent the volume of diamond powder when it is loaded into the container and placed in the HPHT device.

Suitable catalyst materials useful for forming thermally stable ultra-hard polycrystalline materials of this invention are alkali metal carbonates selected from Group I of the periodic table such as $Li_2CO_3$, $Na_2CO_3$, $K_2CO_2$ and mixtures thereof. The use of alkali metal carbonates as the catalyst material, instead of those conventional metal solvent catalysts noted above, is desired because they do not cause the sintered polycrystalline material to undergo graphitization or other phase change at typical high operating temperatures as they are effective as catalysts only at much higher temperatures than would be encountered in cutting or drilling, thereby providing improved thermal stability. Further, ultra-hard polycrystalline materials made using such alkali metal carbonate catalyst materials have properties of wear resistance and hardness that are at least comparable to if not better than that of conventional PCD.

In an example embodiment, the amount of the catalyst material relative to the ultra-hard grains in the mixture can and will vary depending on such factures as the particular thermal, wear, and hardness properties desired for the end use application. In an example embodiment, the catalyst material may comprise from about 2 to 20 percent by volume of the total mixture volume. In a preferred embodiment, the catalyst material comprises in the range of from about 5 to 10 percent of the total mixture volume.

The HPHT device is then activated to subject the container to a desired HPHT condition to effect consolidation and sintering. In an example embodiment, the device is controlled to subject the container a HPHT condition that is sufficient to cause the catalyst material to melt and facilitate the bonding together of the ultra-hard material grains in the mixture, thereby forming the ultra-hard polycrystalline material. In an example embodiment, the device is controlled to subject the container and its contents to a pressure of approximately 7-8 GPa and a temperature of approximately 1,800 to 2,200° C. for a period of approximately 300 seconds. It is to be understood that the exact sintering temperature, pressure and time may vary depending on several factors such as the type of catalyst material selected and/or the proportion of the catalyst material relative to the ultra-hard material. Accordingly, sintering pressures and/or temperatures and/or times other than those noted above may be useful for forming ultra-hard polycrystalline diamond materials of this invention.

Once sintering is complete, the container is removed from the HPHT device and the sintered ultra-hard polycrystalline material is removed from the container. The so-formed ultra-hard polycrystalline material can be configured such that it forms an entire polycrystalline body of a compact, or such that it forms a partial region of a polycrystalline body if a compact. Generally speaking, ultra-hard polycrystalline materials of this invention form the entire or a partial portion of a polycrystalline body that is attached to a substrate, thereby forming an ultra-hard polycrystalline compact.

Figure 2:
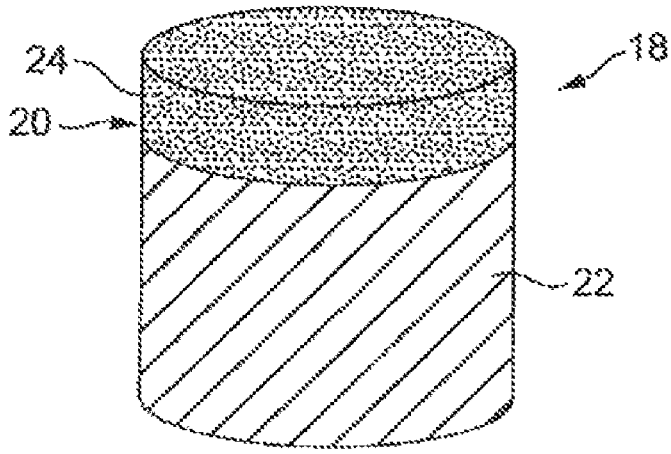
FIG. 2 is a perspective view of a thermally stable ultra-hard polycrystalline compact of this invention comprising an ultra-hard polycrystalline body and a substrate bonded thereto.

FIG. 2 illustrates an example embodiment thermally stable ultra-hard polycrystalline compact 18 of this invention comprising a polycrystalline body 20, that is attached to a desired substrate 22. Substrates useful for forming thermally stable ultra-hard polycrystalline compacts of this invention can be selected from the same general types of materials conventionally used to form substrates for conventional ultra-hard polycrystalline materials, and can include ceramic materials, carbides, nitrides, carbonitrides, cermet materials, and mixtures thereof. In an example embodiment, the substrate material is formed from a cermet material such as cemented tungsten carbide. In another example embodiment, the substrate material is formed from a ceramic material such as alumina or silicon nitride.

The polycrystalline body 20 can be formed entirely or partially from the thermally stable ultra-hard polycrystalline material 24, depending on the particular end use application. While the thermally stable ultra-hard polycrystalline compact 18 is illustrated as having a certain configuration, it is to be understood that compacts of this invention can be configured having a variety of different shapes and sizes depending on the particular tooling, wear and/or cutting application.

Figure 3A:
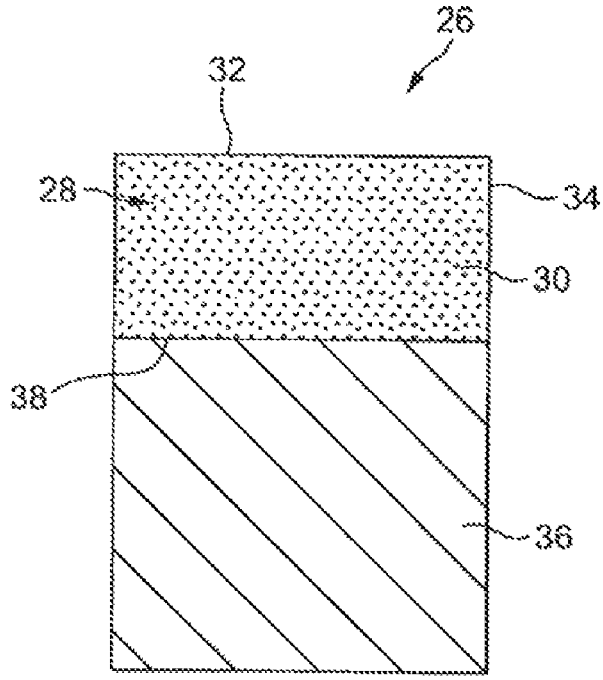
FIGS. 3A to 3D are cross-sectional schematic views of different embodiments of the thermally stable ultra-hard polycrystalline compact of FIG. 2.

FIGS. 3A to 3D illustrate different embodiments of thermally stable ultra-hard polycrystalline compacts constructed in accordance with the principles of this invention. FIG. 3A illustrates a compact embodiment 26 comprising a polycrystalline body 28 that is formed entirely from the thermally stable ultra-hard polycrystalline material 30 according to the HPHT process disclosed above. The body 28 includes a working surface that can extend along the body top surface 32 and/or side surface 34, and is attached to a substrate 36 along an interface surface 38. The interface surface can be planar or nonplanar.

The body 30 can be attached to the substrate 26 by brazing or welding technique, e.g., by vacuum brazing. Alternatively, the body can be attached to the substrate by combining the body and substrate together, and then subjecting the combined body and substrate to a HPHT process. If needed, an intermediate material can be interposed between the body and the substrate to facilitate joining the two together by HPHT process. In an example embodiment, such intermediate material is preferably one is capable of forming a chemical bond with both the body and the substrate, and in an example embodiment can include PCD. Alternatively, the body and substrate can be attached together during the single HPHT process that is used to form the thermally stable ultra-hard polycrystalline material.

Figure 3B:
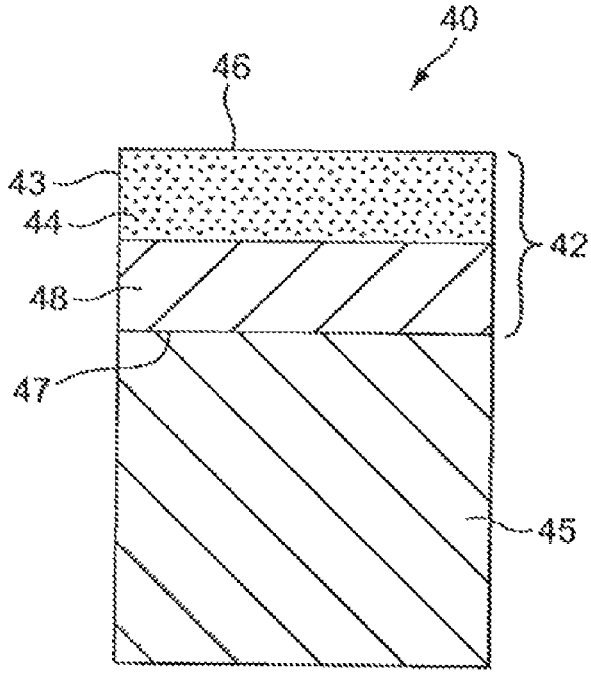

FIG. 3B illustrates a compact embodiment 40 comprising an ultra-hard polycrystalline body 42 that is only partially formed the thermally stable ultra-hard polycrystalline material 44. The body 42 is attached to a substrate 45, and the body/substrate interface 47 can be planar or nonplanar. In this particular embodiment, the thermally stable ultra-hard polycrystalline material 44 occupies an upper region of the body 42 that extends a depth from a top surface 46 of the body. Alternatively, the thermally stable ultra-hard polycrystalline material 44 can be positioned to occupy a different surface of the body that may or may not be a working surface, e.g., it can be positioned along a sidewall surface 43 of the body. The exact thickness of the region occupied by the thermally stable ultra-hard polycrystalline material 44 in this embodiment is understood to vary depending on the particular end use application, but can extend from about 5 to 3,000 microns.

The remaining portion 48 of the body 42 is formed from another type of ultra-hard polycrystalline material, and in an example embodiment is formed from PCD. The thermally stable ultra-hard polycrystalline material 44 can be attached to the remaining body portion 48 by the following different methods that each involves using the thermally stable ultra-hard polycrystalline material after it has been sintered according to the method described above. A first method for making the compact 26 involves sintering both the thermally stable ultra-hard polycrystalline material and the ultra-hard material body separately using different HPHT processes, and then combining the two sintered body elements together by welding or brazing technique. Using this technique, the thermally stable ultra-hard polycrystalline material element is placed into its desired position on the ultra-hard body element and the two are joined together to form the body 42.

A second method involves sintering the thermally stable ultra-hard polycrystalline material and then adding the sintered material element to a volume of ultra-hard grains used to form the remaining body portion before the ultra-hard grains are loaded into a container for sintering within an HPHT device. In an example embodiment, where the ultra-hard grains used to form the remaining body portion is diamond, the sintered thermally stable ultra-hard polycrystalline material element is placed adjacent the desired region of the diamond volume, e.g., adjacent a surface of the volume that be occupied by the element. The contents of the container is then loaded into a HPHT device, and the device is controlled to impose a pressure and temperature condition onto the container sufficient to both sinter the volume of the ultra-hard grains, and join together the already sintered thermally stable ultra-hard polycrystalline material element with the just-sintered remaining body portion. In an example where the ultra-hard grains are diamond grains for forming a PCD remaining body portion, the HPHT device is operated at a pressure of approximately 5,500 MPa and a temperature in the range of from about 1,350 to 1,500° C. for a sufficient period of time.

In some instances it may be necessary to use an intermediate material between the thermally stable ultra-hard polycrystalline material element and the ultra-hard grain volume to achieve a desired bond therebetween. The use of such an intermediate material may depend on the type of ultra-hard materials used to form both the thermally stable ultra-hard polycrystalline material element and the remaining region or portion of the body.

The substrate 45 can be attached to the compact 26, in the first and second methods of making, during the HPHT process used to form the ultra-hard remaining body portion. When the ultra-hard remaining body portion is formed from PCD, a preferred substrate is a cermet material such as cemented tungsten carbide, and the substrate is joined to the ultra-hard remaining body portion during sintering. Alternatively, the ultra-hard remaining body portion can be formed independently of the substrate, and the substrate can be attached thereto by a subsequent HPHT process or by a welding or brazing process.

While a particular example embodiment compact has been described above and illustrated in FIG. 3B as one comprising the thermally stable ultra-hard polycrystalline material 44 extending along an entire upper region of the body 42, it is to be understood that other variations of this embodiment are within the scope of this invention. For example, instead of extending along the entire upper region, the compact can be configured with the thermally stable ultra-hard polycrystalline material 44 extending along only a partial portion of the body upper region. In which case the top surface 46 of the body 42 would comprise both a region including the thermally stable ultra-hard polycrystalline material and a region including the remaining body material. In another example, the thermally stable ultra-hard polycrystalline material can be provided in the form of an annular element that extends circumferentially around a peripheral edge of the body top surface 46 and/or a side wall surface 43 with the remaining body portion occupying a central portion of the top surface in addition to the remaining portion of the body extending to and connecting with the substrate 45. These are but a few examples of how compacts according to this invention embodiment may be configured differently than that illustrated in FIG. 3B.

Figure 3C:
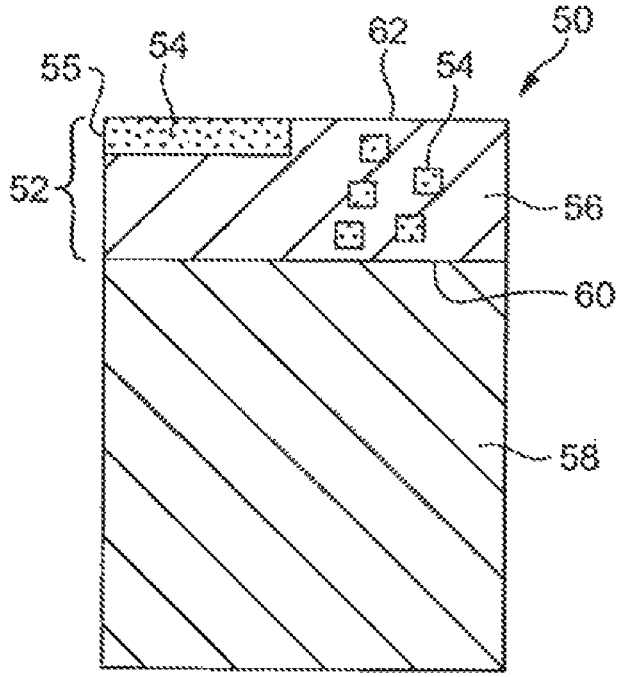

FIG. 3C illustrates another compact embodiment 50 comprising an ultra-hard polycrystalline body 52 that is only partially formed the thermally stable ultra-hard polycrystalline material 54. In this particular embodiment, the thermally stable ultra-hard polycrystalline material 54 is provided in the form of one or more elements that are located at one or more desired positions within a remaining body portion 56. The remaining body portion 56 is attached to a desired substrate 58, and the body/substrate interface 60 can planar or nonplanar.

Unlike the compact embodiment illustrated in FIG. 3B, the thermally stable ultra-hard polycrystalline material element 54 in this compact embodiment is provided in the form of one or more discrete elements 54 that are at least partially surrounded by the remaining body portion 42. The configuration and placement position of the thermally stable ultra-hard polycrystalline element or elements 54 are understood to vary depending on the particular end use application. In the example illustrated, the thermally stable ultra-hard polycrystalline element 54 is positioned along a portion of the body top surface 62 adjacent a peripheral edge of the body, e.g., along what can be a working or cutting surface of the compact. Alternatively, or additionally, the element 54 can be positioned along a portion of the body sidewall surface 55. Still further, instead of one thermally stable ultra-hard polycrystalline element, the body 56 can comprise a number of such elements 54 positioned at different locations within the body to provide the desired properties of improved thermal stability, hardness, and wear resistance to the body to meet certain end use applications. The compact embodiment of FIG. 3C can be formed in the same manner and from the same materials as that described above for the compact embodiment of FIGS. 3A and 3B.

Figure 3D:
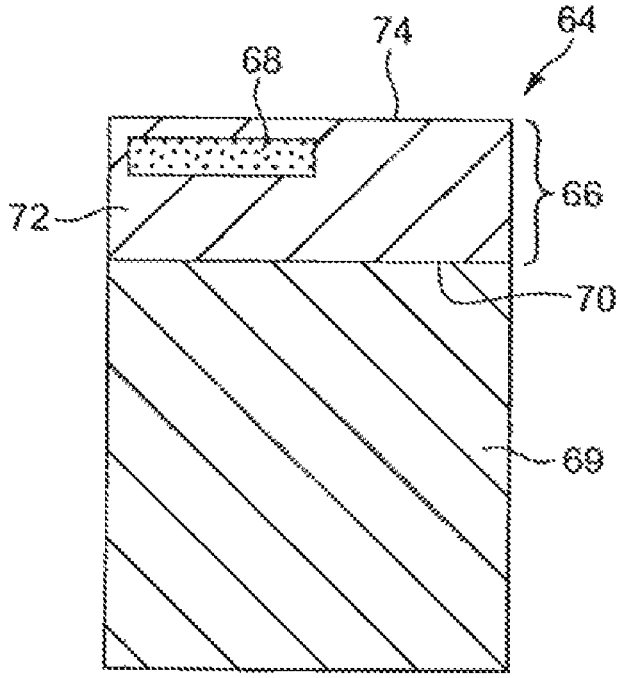

FIG. 3D illustrates a still other compact embodiment 64 comprising an ultra-hard polycrystalline body 66, that is only partially formed the thermally stable ultra-hard polycrystalline material 68, that is attached to a substrate 69, and that may have a planar or nonplanar body/substrate interface 70. In this particular embodiment, the thermally stable ultra-hard polycrystalline material 68 is provided in the form of an element that is located at a desired position within a remaining body portion 56.

Like the compact embodiment illustrated in FIG. 3C, the thermally stable ultra-hard polycrystalline material element 68 in this compact embodiment is provided in the form of a discrete element 68 that is surrounded by the remaining body portion 72. The configuration and placement position of the thermally stable ultra-hard polycrystalline element or elements 68 within the body 66 is understood to vary depending on the particular end use application. In the example illustrated, the thermally stable ultra-hard polycrystalline element 68 is positioned beneath a top surface 74 body in a placement position that can and will vary depending on the particular end use application for the compact. Like the compact embodiment of FIG. 3C, instead of one element 68, the body 66 can comprise a number of such elements 68 positioned at different locations within the body as called for to provide desired properties of improved thermal stability, hardness, and wear resistance to the body to meet certain end use applications. The compact embodiment of FIG. 3D can be formed in the same manner and from the same materials as that described above for the compact embodiment of FIGS. 3A and 3B.

A feature of thermally stable ultra-hard polycrystalline materials and compacts constructed according to the principles of this invention is that they provide properties of thermal stability, wear resistance, and hardness that are superior to conventional ultra-hard polycrystalline materials such as PCD, thereby enabling such compact to be used in tooling, cutting and/or wear applications calling for high levels of thermal stability, wear resistance and/or hardness. Further, compacts of this invention are configured having a substrate that permits attachment of the compact by conventional methods such as brazing or welding to variety of different tooling, cutting and wear devices to greatly expand the types of potential use applications for compacts of this invention.

Thermally stable ultra-hard polycrystalline materials and compacts of this invention can be used in a number of different applications, such as tools for mining, cutting, machining and construction applications, where the combined properties of thermal stability, wear resistance and hardness are highly desired. Thermally stable ultra-hard polycrystalline materials and compacts of this invention are particularly well suited for forming working, wear and/or cutting components in machine tools and drill and mining bits such as roller cone rock bits, percussion or hammer bits, diamond bits, and shear cutters.

Figure 4:
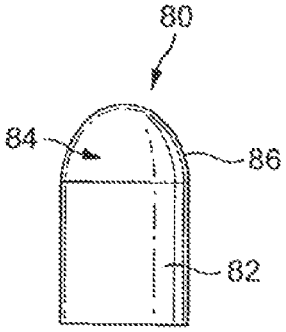
FIG. 4 is a perspective side view of an insert, for use in a roller cone or a hammer drill bit, comprising the thermally stable ultra-hard polycrystalline compacts of FIGS. 3A to 3D.

FIG. 4 illustrates an embodiment of a thermally stable ultra-hard polycrystalline compact of this invention provided in the form of an insert 80 used in a wear or cutting application in a roller cone drill bit or percussion or hammer drill bit. For example, such inserts 80 can be formed from blanks comprising a substrate portion 82 made from one or more of the substrate materials disclosed above, and an ultra-hard polycrystalline material body 84 having a working surface 86 formed from the thermally stable ultra-hard polycrystalline material region of the body 84. The blanks are pressed or machined to the desired shape of a roller cone rock bit insert. While an insert having a particular configuration has been illustrated, it is to be understood that thermally stable ultra-hard polycrystalline materials and compacts of this invention can be embodied in inserts configured differently than that illustrated.

Figure 5:
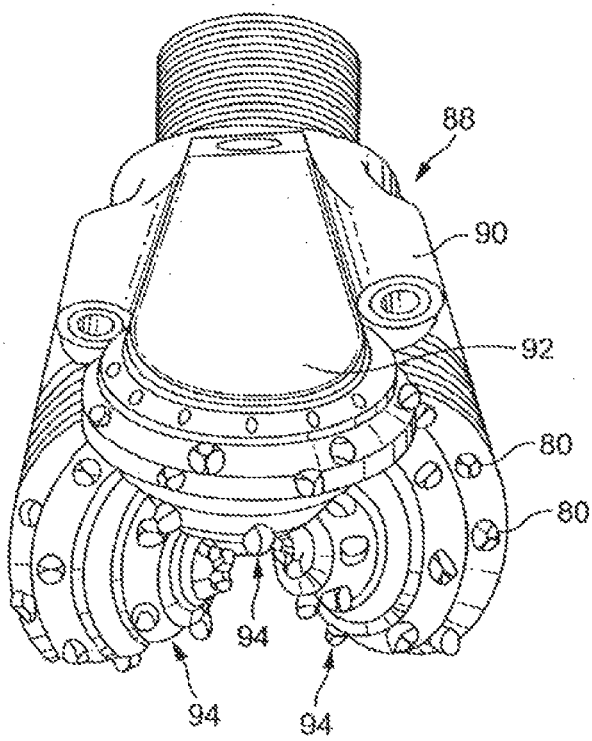
FIG. 5 is a perspective side view of a roller cone drill bit comprising a number of the inserts of FIG. 4.

FIG. 5 illustrates a rotary or roller cone drill bit in the form of a rock bit 88 comprising a number of the wear or cutting inserts 80 disclosed above and illustrated in FIG. 4. The rock bit 88 comprises a body 90 having three legs 92, and a roller cutter cone 94 mounted on a lower end of each leg. The inserts 80 can be fabricated according to the method described above. The inserts 80 are provided in the surfaces of each cutter cone 48 for bearing on a rock formation being drilled.

Figure 6:
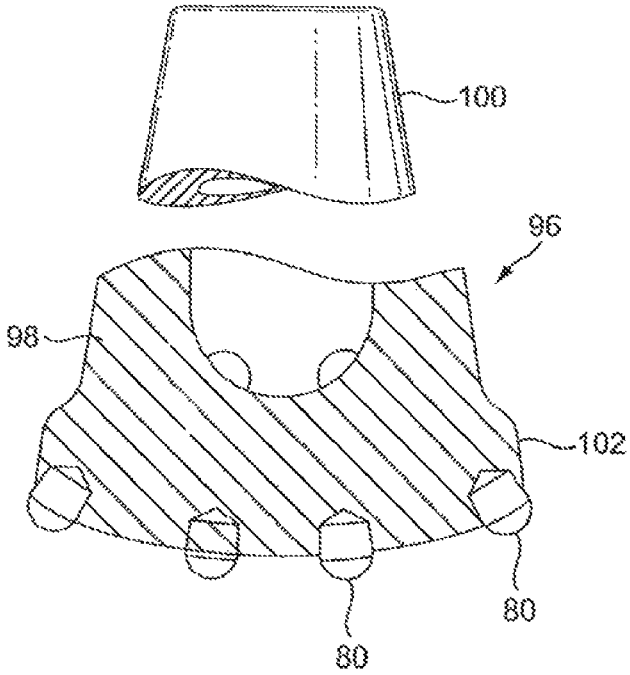
FIG. 6 is a perspective side view of a percussion or hammer bit comprising a number of inserts of FIG. 4.

FIG. 6 illustrates the inserts described above as used with a percussion or hammer bit 96. The hammer bit comprises a hollow steel body 98 having a threaded pin 100 on an end of the body for assembling the bit onto a drill string (not shown) for drilling oil wells and the like. A plurality of the inserts 80 is provided in the surface of a head 102 of the body 98 for bearing on the subterranean formation being drilled.

Figure 7:
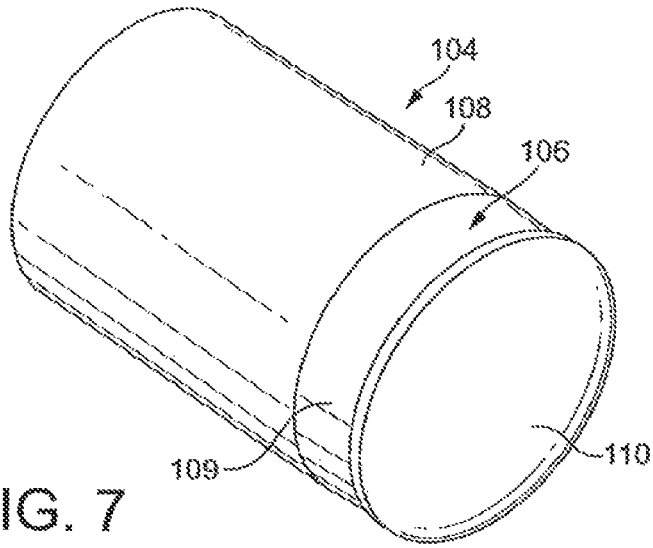
FIG. 7 is a schematic perspective side view of a diamond shear cutter comprising the thermally stable ultra-hard polycrystalline compact of FIGS. 3A to 3D.

FIG. 7 illustrates a thermally stable ultra-hard polycrystalline compact of this invention as embodied in the form of a shear cutter 104 used, for example, with a drag bit for drilling subterranean formations. The shear cutter 104 comprises an ultra-hard polycrystalline body 106 that is sintered or otherwise attached to a cutter substrate 108. The ultra-hard polycrystalline body 106 includes the thermally stable ultra-hard polycrystalline material 109 of this invention and includes a working or cutting surface 110 that can be formed from the thermally stable ultra-hard polycrystalline material. While a shear cutter having a particular configuration has been illustrated, it is to be understood that thermally stable ultra-hard polycrystalline materials and compacts of this invention can be embodied in shear cutters configured differently than that illustrated.

Figure 8:
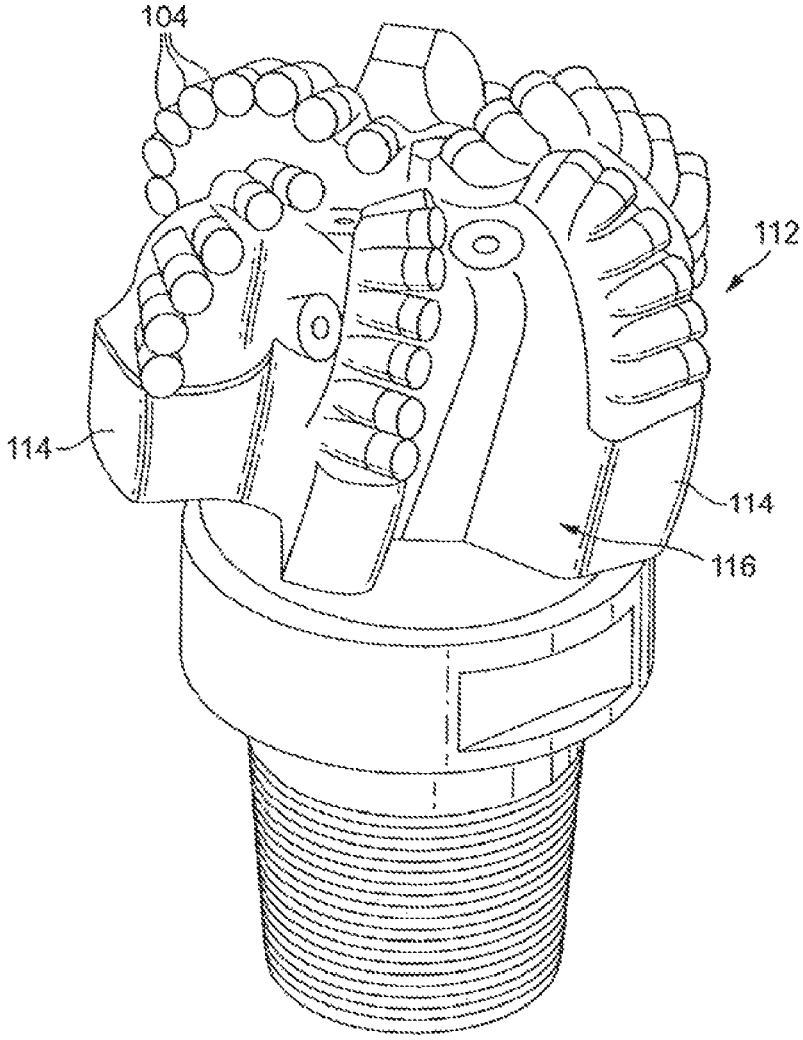
FIG. 8 is a perspective side view of a drag bit comprising a number of the shear cutters of FIG. 7.

FIG. 8 illustrates a drag bit 112 comprising a plurality of the shear cutters 104 described above and illustrated in FIG. 7. The shear cutters are each attached to blades 114 that extend from a head 116 of the drag bit for cutting against the subterranean formation being drilled.

Other modifications and variations of thermally stable ultra-hard polycrystalline materials and compacts of this invention will be apparent to those skilled in the art. It is, therefore, to be understood that within the scope of the appended claims, this invention may be practiced otherwise than as specifically described.

What is claimed is:

1. A method for making a thermally stable ultra-hard polycrystalline construction comprising the steps of:

forming a thermally stable ultra-hard polycrystalline material by:

combining an ultra-hard material precursor selected from the group consisting of diamond, cubic boron nitride, and combinations thereof with an alkali metal carbonate to form a mixture; and subjecting the mixture to a high pressure-high temperature condition to form a sintered thermally stable ultra-hard polycrystalline material; and combining the thermally stable ultra-hard polycrystalline material with an ultra-hard material precursor selected from the group consisting of diamond, cubic boron nitride and combinations thereof; and subjecting the combination to a high pressure-high temperature condition to form a construction having a first region comprising the sintered thermally stable ultra-hard polycrystalline material, and a second region comprising a sintered polycrystalline material.

2. The method as recited in claim 1 further comprising making a thermally stable ultra-hard construction by attaching a substrate to the thermally stable ultra-hard polycrystalline material.

3. The method as recited in claim 1 wherein the ultra-hard precursor material used to form both the thermally stable ultra-hard polycrystalline material and the polycrystalline material is diamond, and wherein the polycrystalline material is polycrystalline diamond.

4. The method as recited in claim 1 wherein the construction second region comprises a catalyst material selected from Group VIII of the Periodic table.

5. The method as recited in claim 1 wherein the construction second region is substantially free of the alkali metal carbonate.

6. The method as recited in claim 1 further comprising a substrate attached to the construction.

7. The method as recited in claim 6 wherein the substrate is attached to the construction by the high pressure-high temperature process used to form the construction.

8. The method as recited in claim 1 wherein the thermally stable ultra-hard polycrystalline material is provided in the form of a number of discrete elements, and the resulting construction comprises a plurality of first phases formed from the discrete elements dispersed in a second phase formed from the polycrystalline material.

9. The method as recited in claim 1 wherein the thermally stable ultra-hard polycrystalline material is positioned along at least a surface portion of the resulting thermally stable ultra-hard polycrystalline construction.

10. The method as recited in claim 9 wherein the surface portion includes one or both of a construction top surface and side surface.

11. The method as recited in claim 1 wherein the ultra-hard precursor material used to form the thermally stable ultra-hard polycrystalline material is diamond.

12. The method as recited in claim 1 wherein the first and second regions are each separate continuous regions.

13. A method for making a thermally stable ultra-hard polycrystalline construction comprising the steps of:

forming a thermally stable ultra-hard polycrystalline material by:

combining an ultra-hard material precursor selected from the group consisting of diamond, cubic boron nitride, and combinations thereof with an alkali metal carbonate to form a mixture; and subjecting the mixture to a high pressure-high temperature condition to form a sintered thermally stable ultra-hard polycrystalline material;

combining the sintered thermally stable ultra-hard material with a sintered polycrystalline material comprising a catalyst material selected from Group VIII of the Periodic table; and attaching the sintered thermally stable ultra-hard material to the sintered polycrystalline material to form a construction.

14. The method as recited in claim 13 further comprising the step of attaching a substrate to the construction.

15. A method for making a thermally stable ultra-hard polycrystalline construction comprising the steps of:

combining diamond grains with an alkali metal carbonate to form a mixture; and subjecting the mixture to a high pressure-high temperature condition to form a sintered thermally stable ultra-hard polycrystalline material;

combining the sintered thermally stable ultra-hard polycrystalline material with a volume of diamond grains to form an assembly; and subjecting the assembly in the presence of a solvent metal catalyst to a high pressure-high temperature condition to sinter the diamond grains and form polycrystalline diamond, and to attach the sintered thermally stable ultra-hard polycrystalline material to the polycrystalline diamond to form a construction.

16. The method as recited in claim 15 further comprising attaching a substrate to the construction to form a compact, and wherein the substrate is attached during the step of subjecting to form the polycrystalline diamond.

17. The method as recited in claim 15 wherein the polycrystalline diamond is substantially free of the alkali metal carbonate.

18. The method as recited in claim 15 wherein the thermally stable ultra-hard polycrystalline material occupies a first one region of the construction, and the polycrystalline diamond occupies a second region of the construction.

19. The method as recited in claim 18 wherein the first region comprises a plurality of elements dispersed within the second region, and wherein the second region is a continuous phase.

20. The method as recited in claim 18 wherein the first and second regions are each separate continuous phases.

21. A method for making a thermally stable ultra-hard polycrystalline construction comprising the steps of:

combining diamond grains with an alkali metal carbonate to form a mixture; and subjecting the mixture to a high pressure-high temperature condition to form a sintered thermally stable ultra-hard polycrystalline material; and combining diamond grains and subjecting the diamond grains to a high pressure-high temperature condition in the presence of a solvent catalyst material to form a sintered polycrystalline material and to attach the thermally stable ultra-hard polycrystalline material to the polycrystalline material to form the construction;

wherein the thermally stable ultra-hard polycrystalline material is provided as a plurality of discrete elements, and the resulting construction comprises a plurality of first phases formed from the discrete elements dispersed in a continuous second phase formed from the polycrystalline material.

22. The method as recited in claim 21 further comprising attaching a substrate to the construction to form a compact.

23. The method as recited in claim 21 wherein the polycrystalline material is substantially free of the alkali metal carbonate.

* * * * *